US010278464B2

(12) United States Patent
King

(10) Patent No.: US 10,278,464 B2
(45) Date of Patent: May 7, 2019

(54) ADAPTABLE LUGGAGE CASE AND WORKSPACE COMBINATION

(71) Applicant: Brian King, Chicago, IL (US)

(72) Inventor: Brian King, Chicago, IL (US)

( * ) Notice: Subject to any disclaimer, the term of this patent is extended or adjusted under 35 U.S.C. 154(b) by 159 days.

(21) Appl. No.: 15/444,122

(22) Filed: Feb. 27, 2017

(65) Prior Publication Data

US 2017/0245608 A1 Aug. 31, 2017

Related U.S. Application Data

(60) Provisional application No. 62/299,663, filed on Feb. 25, 2016.

(51) Int. Cl.

| | |
|---|---|
| ***B41J 29/13*** | (2006.01) |
| ***A45C 9/00*** | (2006.01) |
| ***A45C 13/26*** | (2006.01) |
| ***A45C 15/00*** | (2006.01) |
| ***A45C 15/06*** | (2006.01) |
| ***A45C 13/18*** | (2006.01) |
| ***A47B 3/10*** | (2006.01) |
| *A45C 5/14* | (2006.01) |
| *A45C 13/02* | (2006.01) |

(52) U.S. Cl.

CPC ..... *A45C 9/00* (2013.01); *A45C 13/18* (2013.01); *A45C 13/262* (2013.01); *A45C 15/00* (2013.01); *A45C 15/06* (2013.01); *A47B 3/10* (2013.01); *A45C 5/14* (2013.01); *A45C 13/02* (2013.01); *A45C 2013/265* (2013.01); *A45C 2013/267* (2013.01)

(58) Field of Classification Search

CPC .. A45C 9/00; A45C 3/02; A45C 13/02; A45C 5/00; A47B 3/10

USPC ..... 190/11, 18 A; 206/320, 316.2, 305; 312/241, 281

See application file for complete search history.

(56) References Cited

U.S. PATENT DOCUMENTS

| | | | | |
|---|---|---|---|---|
| 2,522,322 A * | 9/1950 | Wallace | ..... | A45C 9/00 126/304 A |
| 2,609,072 A * | 9/1952 | Levinson | ..... | A47B 3/10 108/33 |
| 2,805,905 A * | 9/1957 | Levitan | ..... | A47B 31/00 108/145 |

(Continued)

*Primary Examiner* — Fenn C Mathew
*Assistant Examiner* — Cynthia F Collado

(57) ABSTRACT

An adaptable luggage case and workspace combination stores personal effects for travel. The adaptable luggage case and workspace combination is able to be configured as a desk to provide a workspace for the user or as a rolling luggage case for travel. The adaptable luggage case and workspace combination includes a luggage case, a collapsible workstation, an electrical housing, a first pair of telescoping-leg supports, and a second pair of telescoping-leg supports. The luggage case allows storage and transportation of personal effects. The collapsible workstation is connected to a case lid. The collapsible workstation expands providing a workspace for the user. The electrical housing supports a rechargeable battery to provide power to mobile or electronic devices during travel. The first pair of telescoping-leg supports and the second pair of telescoping-leg supports support the luggage case when the adaptable luggage case and workspace combination is configured as a desk.

18 Claims, 10 Drawing Sheets

(56) References Cited

U.S. PATENT DOCUMENTS

| | | | | | |
|---|---|---|---|---|---|
| 4,034,518 | A * | 7/1977 | Trecker | A45C 9/00 | 190/11 |
| 4,856,627 | A * | 8/1989 | Polatov | A45C 9/00 | 190/11 |
| 5,813,063 | A * | 9/1998 | Watkins | E03C 1/18 | 4/626 |
| 6,637,350 | B2 * | 10/2003 | McKsymick | A47B 3/06 | 108/25 |
| 7,249,771 | B1 * | 7/2007 | Brennan | A47J 37/0704 | 280/35 |
| 2005/0140119 | A1 * | 6/2005 | Wong | B62B 3/027 | 280/651 |
| 2007/0018817 | A1 * | 1/2007 | Marmaropoulos | A45C 15/00 | 340/571 |
| 2015/0342317 | A1 * | 12/2015 | Barmes | A45C 5/03 | 190/18 A |

* cited by examiner

ADAPTABLE LUGGAGE CASE AND WORKSPACE COMBINATION

The current application claims a priority to the U.S. Provisional Patent application Ser. No. 62/299,663 filed on Feb. 25, 2016. The current application is filed on Feb. 27, 2017 while Feb. 25, 2017 was on a weekend.

FIELD OF THE INVENTION

The present invention relates generally to luggage. More specifically, the present invention relates to luggage with at least one workspace surface and support legs that establish stability for configuration as a desktop working surface. The present invention provides power through a solar panel or rechargeable battery to power a reading light, a digital clock, and a global positioning system (GPS) for use during travel.

BACKGROUND OF THE INVENTION

As computer technology continues to develop and prices decrease exponentially as exemplified in Wright's law, where the cost of a unit decreases as a function of the cumulative production, laptop or notebook computers continue to become more prevalent at the office, home and school. The portability of these devices coupled with the same computer power as some desktop computers make them very popular; however, one aspect of notebook computers that hasn't changed much over the years is the susceptibility to physical damage. A small fall or drop can cause hundreds or thousands of dollars in repair costs for the device. Also, many computing activities require or become more convenient using peripherals and accessories that are not often handy when traveling with a notebook computer. Finally, balance becomes an issue when a user supports the notebook computer on the user's knees and the user attempts to refer to a plurality of papers, folders and documents as well. Accordingly, a need has developed for a device that extends the usability and functionality of notebook computers while providing increased physical protection for the computer while in transit as well as use. The development of the present invention fulfills this need.

The present invention is an adaptable luggage case and workspace combination. The present invention is a portable desk with enhanced features specifically for use with a portable notebook computer and accessories. Upon initial observation of the present invention, the present invention looks remarkably like a conventional piece of luggage; however, on closer inspection, the present invention opens to reveal a padded compartment to allow the storage for a notebook computer. Additional compartments within a luggage body provide storage for accessory devices, such as outboard storage devices, computer media, cellular phones, portable battery banks, tablet accessories, headphones, and papers. Telescoping legs attached to the luggage body extend downward to provide floor support for use while sitting in a chair. Finally, with the lid closed, a collapsible workstation provides a large, flat surface for writing use and support for a notebook computer. The use of the present invention greatly extends the functionality of a notebook computer while providing a high-level of physical protection against damage during transport.

DETAIL DESCRIPTIONS OF THE INVENTION

All illustrations of the drawings are for the purpose of describing selected versions of the present invention and are not intended to limit the scope of the present invention.

The present invention is an adaptable luggage case and workspace combination. The present invention is a portable desk with enhanced features specifically for supporting a portable notebook computer and associated accessories, as well as for transporting personal effects, such as clothing, jewelry, and toiletries. The present invention is adjustable in height when the present invention is configured as a desk, in order to accommodate differing sitting heights of the user during travel.

Figure 1:
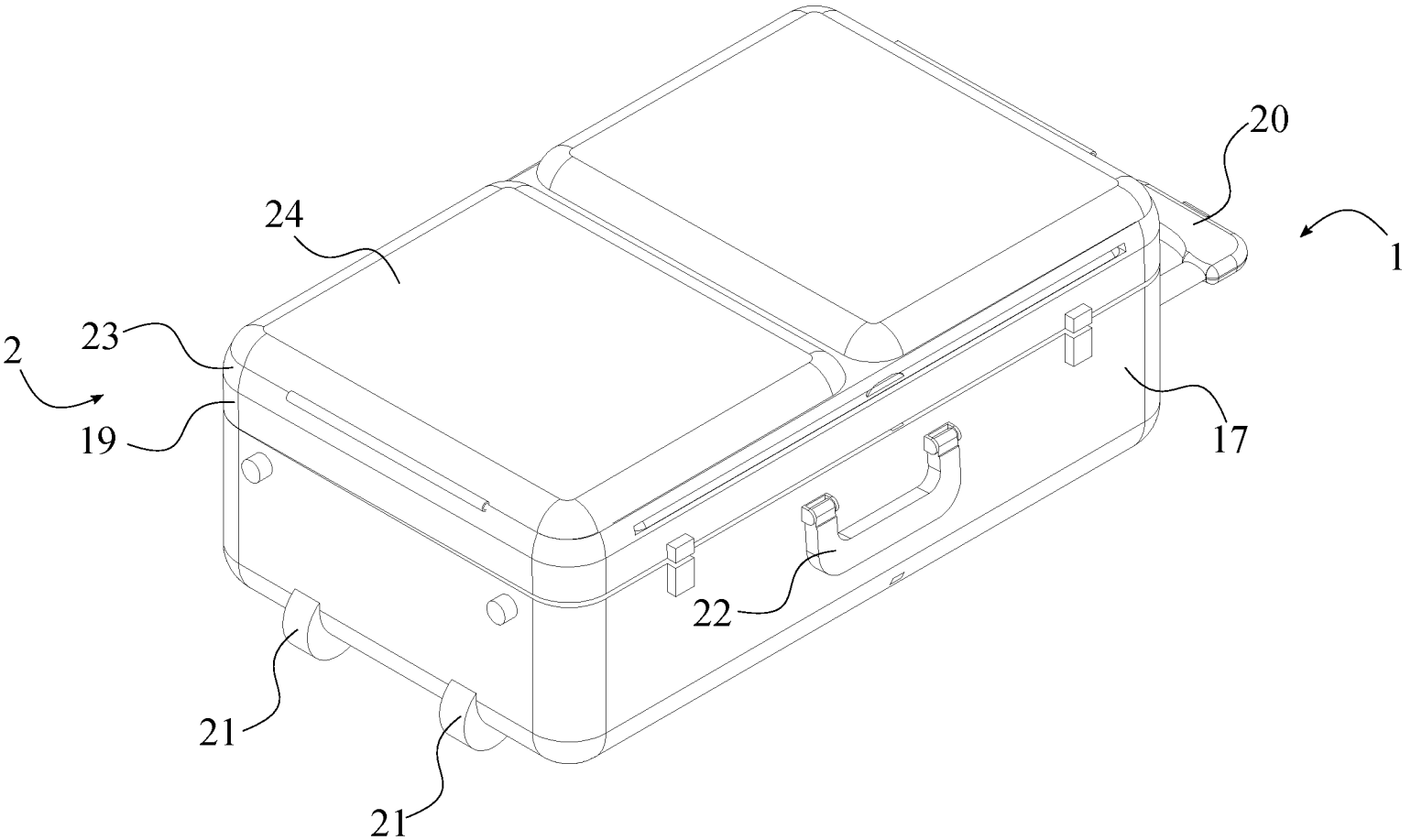
FIG. 1 is a perspective view of the present invention, wherein the invention is collapsed for travel.
Figure 2:
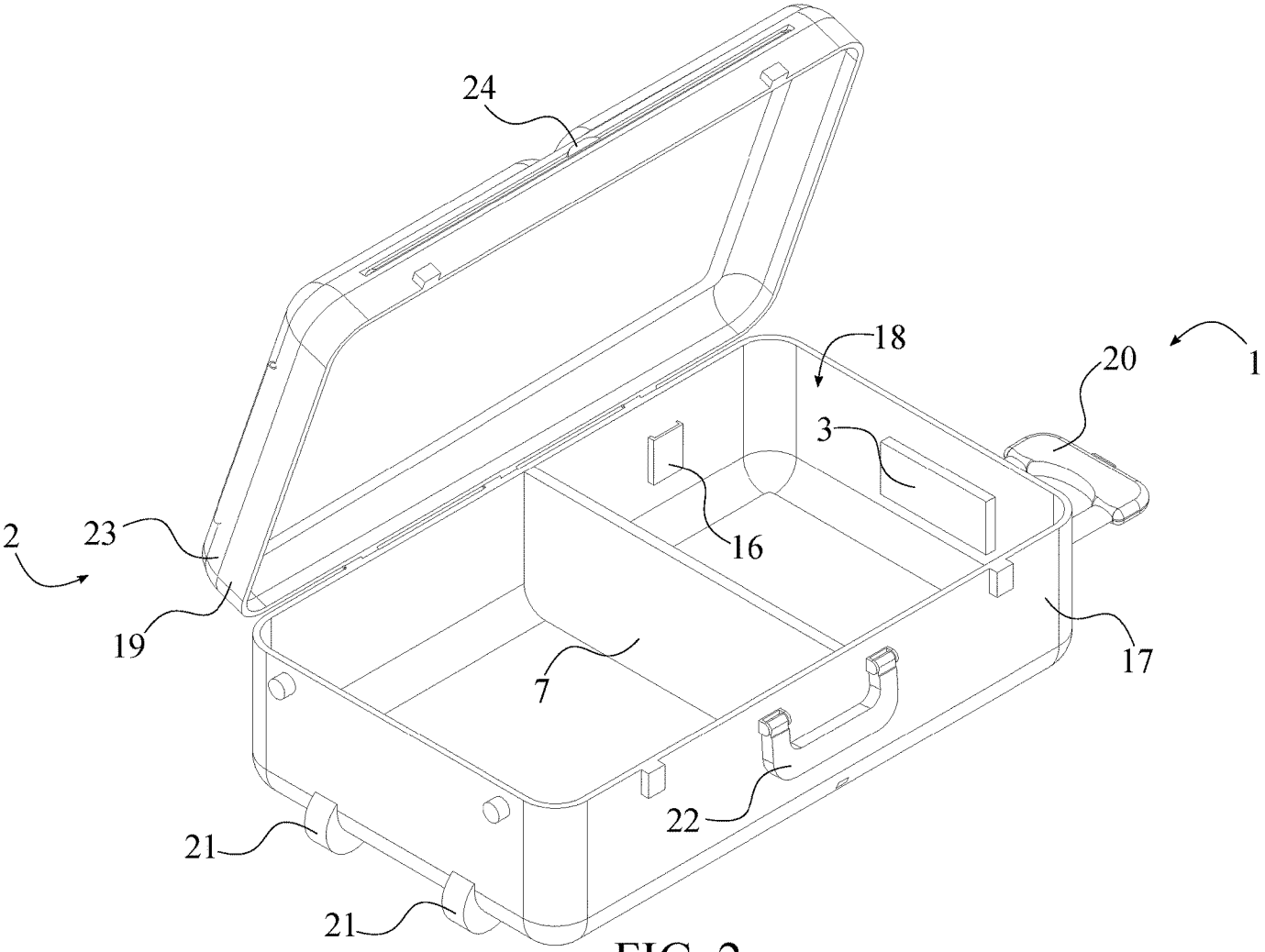
FIG. 2 is a perspective view of the present invention, wherein the case lid is open.
Figure 3:
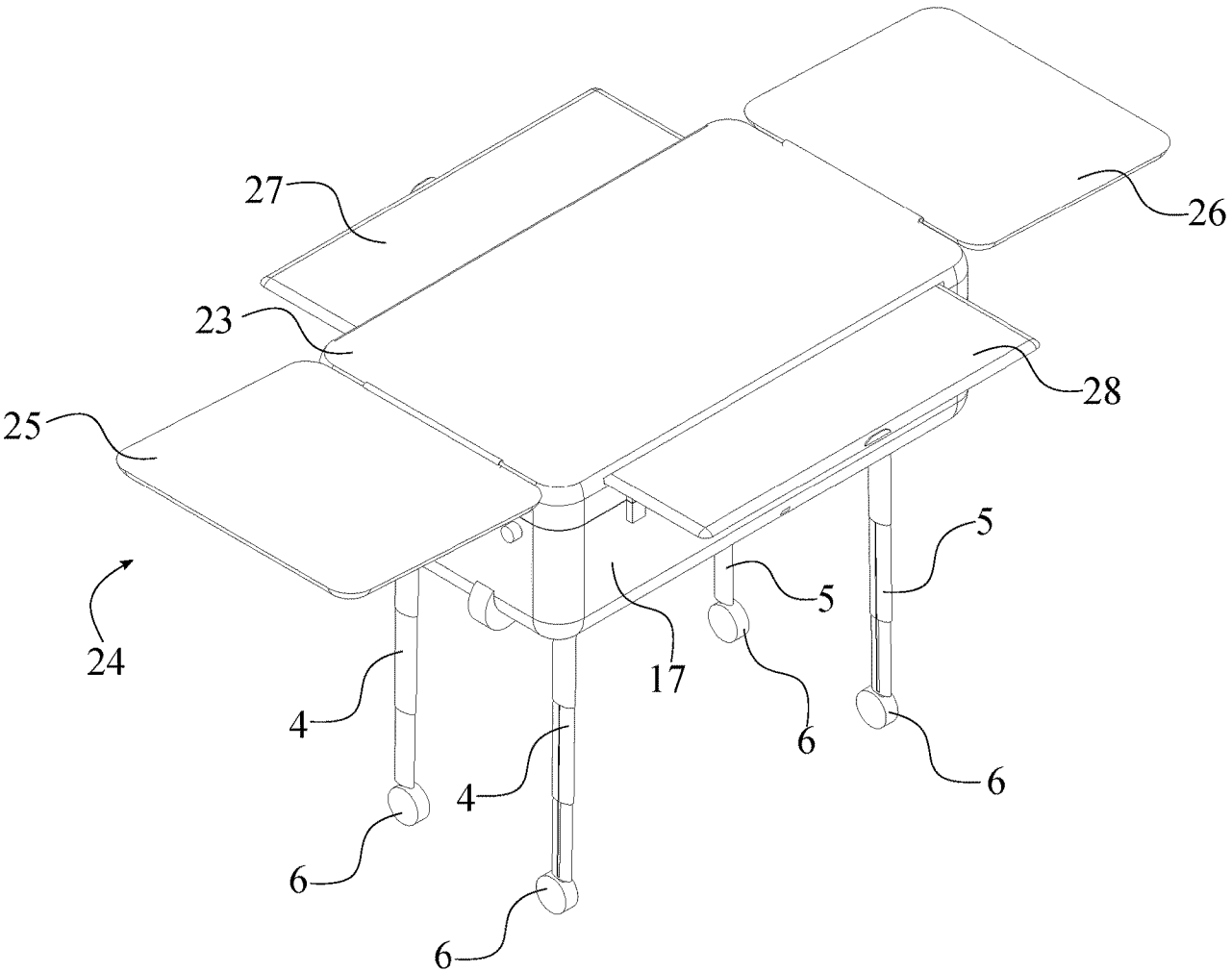
FIG. 3 is a perspective view of the present invention, wherein the present invention is configured as a desk.

In accordance to FIG. 1, FIG. 2, and FIG. 3, the present invention comprises a luggage case 1, a collapsible workstation 2, an electrical housing 3, a first pair of telescoping-leg supports 4, and a second pair of telescoping-leg supports 5. The luggage case 1 allows the storage and transportation of personal effects. As detailed in FIG. 2, the luggage case 1 comprises a luggage body 17, a storage compartment 18, and a case lid 19. The luggage body 17 provides structure to the present invention. The storage compartment 18 allows for the storage of personal effects within the luggage body 17. The storage compartment 18 traverses into the luggage body 17 to allow personal effects to be positioned and secured within the luggage body 17. The case lid 19 secures the contents of the storage compartment 18 within the luggage body 17. The case lid 19 is perimetrically connected to the luggage body 17 about the storage compartment 18. The collapsible workstation 2 provides a solid work space for the user to write, draw, or rest objects upon; objects such as a notebook computer, mobile phones, paper, mugs, etc.

The collapsible workstation 2 comprises a workstation base 23 and at least one extendable work surface 24, illustrated in FIG. 2. The workstation base 23 is a primary surface to place objects. The workstation base 23 is adjacently connected to the case lid 19. The workstation base 23 is oppositely positioned to the storage compartment 18 about the case lid 19, such that the workstation base 23 is externally accessible on the present invention. The at least one extendable work surface 24 is a retractable surface to expand the effective workspace provided to the user. The at least one extendable work surface 24 is connected to the workstation base 23, detailed in FIG. 1 to FIG. 7.

Figure 6:
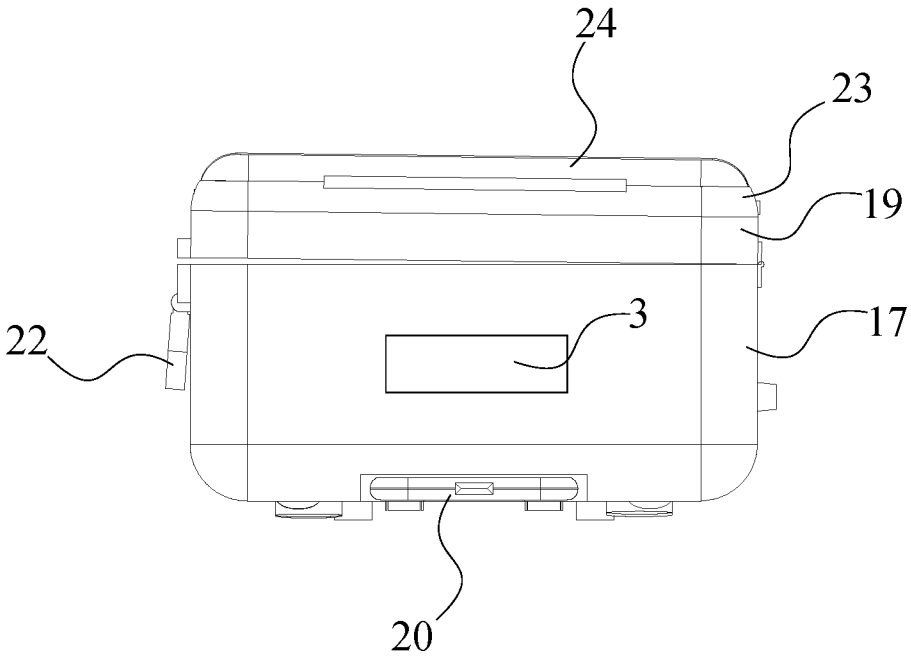
FIG. 6 is a right view of the present invention.
Figure 7:
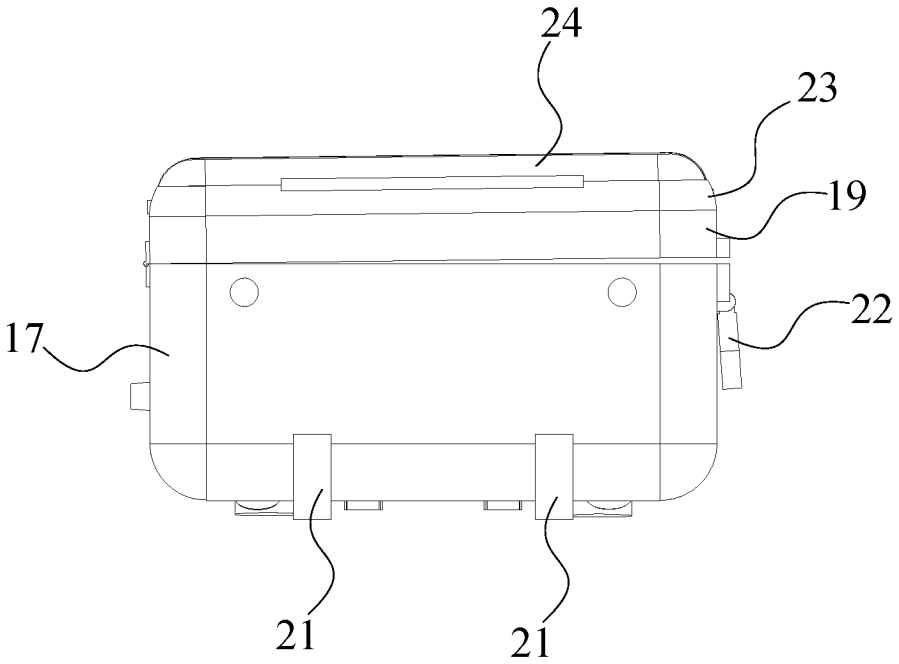
FIG. 7 is a left view of the present invention.

In accordance to FIG. 2 and FIG. 6, the electrical housing 3 provides a containment for electrical components of the present invention. The electrical housing 3 is laterally integrated into the luggage body 17 in order to house electrical components as well as provide an adaptor between electrical components and external electronic devices, such as mobile phones.

Figure 9:
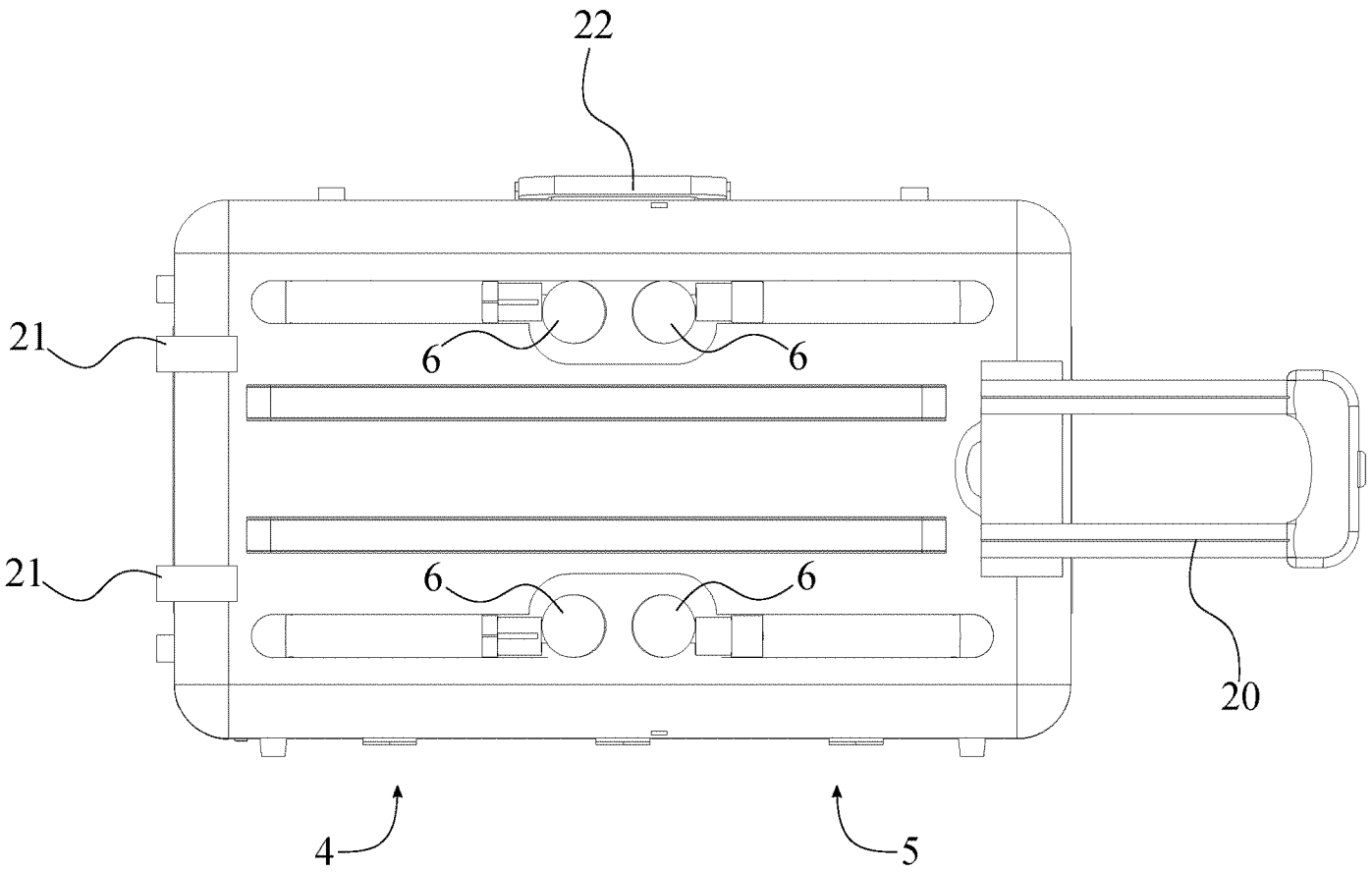
FIG. 9 is a bottom view of the present invention.

The first pair of telescoping-leg supports 4 and the second pair of telescoping-leg supports 5 support the present invention when the present invention is configured as a desk, detailed in FIG. 3 and FIG. 9. The first pair of telescoping-leg supports 4 and the second pair of telescoping-leg supports 5 are hingedly connected to the luggage body 17, opposite to the case lid 19. The hinged connection allows the first pair of telescoping-leg supports 4 and the second pair of telescoping-leg supports 5 to be folded adjacent to the luggage body 17 during transport of the present invention, as shown in FIG. 9 or extended out from the luggage body 17 to configure the present invention as a desk, as shown in FIG. 3. The first pair of telescoping-leg supports 4 and the second pair of telescoping-leg supports 5 are positioned opposite to each other across the luggage body 17. Further, each of the first pair of telescoping-leg supports 4 is offset from each other. Similarly, each of the second pair of telescoping-leg supports 5 is offset from each other. This configuration allows for the even support of the luggage body 17 while the present invention is configured as a desk.

The first pair of telescoping-leg supports 4 and the second pair of telescoping legs supports 5 allow the user to adjust the height of the present invention when the invention is configured as a desk for a user in a seated position or a standing position. Adjusting the height of the present invention for a standing position provides the user with health and productivity benefits from standing while working including, but not limited to, decreased spinal pressure and increased blood circulation.

In accordance to the preferred embodiment of the present invention, the luggage case 1 further comprises an extendable handle 20 and a pair of casters 21, detailed in FIG. 1, FIG. 2 and FIG. 4 to FIG. 9. The extendable handle 20 allow the user to pull the present invention along a ground surface to maneuver the present invention during travel. The extendable handle 20 is telescopically integrated into the luggage body 17. The extendable handle 20 is positioned opposite to the case lid 19. The pair of casters 21 roll along the ground surface as the present invention is pulled with the extendable handle 20. The pair of casters 21 is rotatably and laterally connected to the luggage body 17. Further, the pair of casters 21 is oppositely positioned to the case lid 19. The pair of casters 21 is positioned offset from each other, dispersing the weight of the luggage case 1 and contents within, across each of the pair of casters 21. Therefore, this configuration for the present invention is more easily maneuvered by reducing friction between the luggage body 17 and the ground surface, as the present invention is pulled by the extendable handle 20.

In a more specific embodiment of the present invention, the present invention comprises a lateral handle 22, shown in FIG. 1, FIG. 2, FIG. 4, and FIG. 6 to FIG. 9. The lateral handle 22 allows the user to carry and lift the present invention, when pulling the present invention across the ground surface is not optimal or viable for transportation of the present invention. The lateral handle 22 is laterally and centrally connected to the luggage body 17 in order to distribute the weight of the present invention and contents stored within evenly as the user lifts the present invention with the lateral handle 22.

Figure 4:
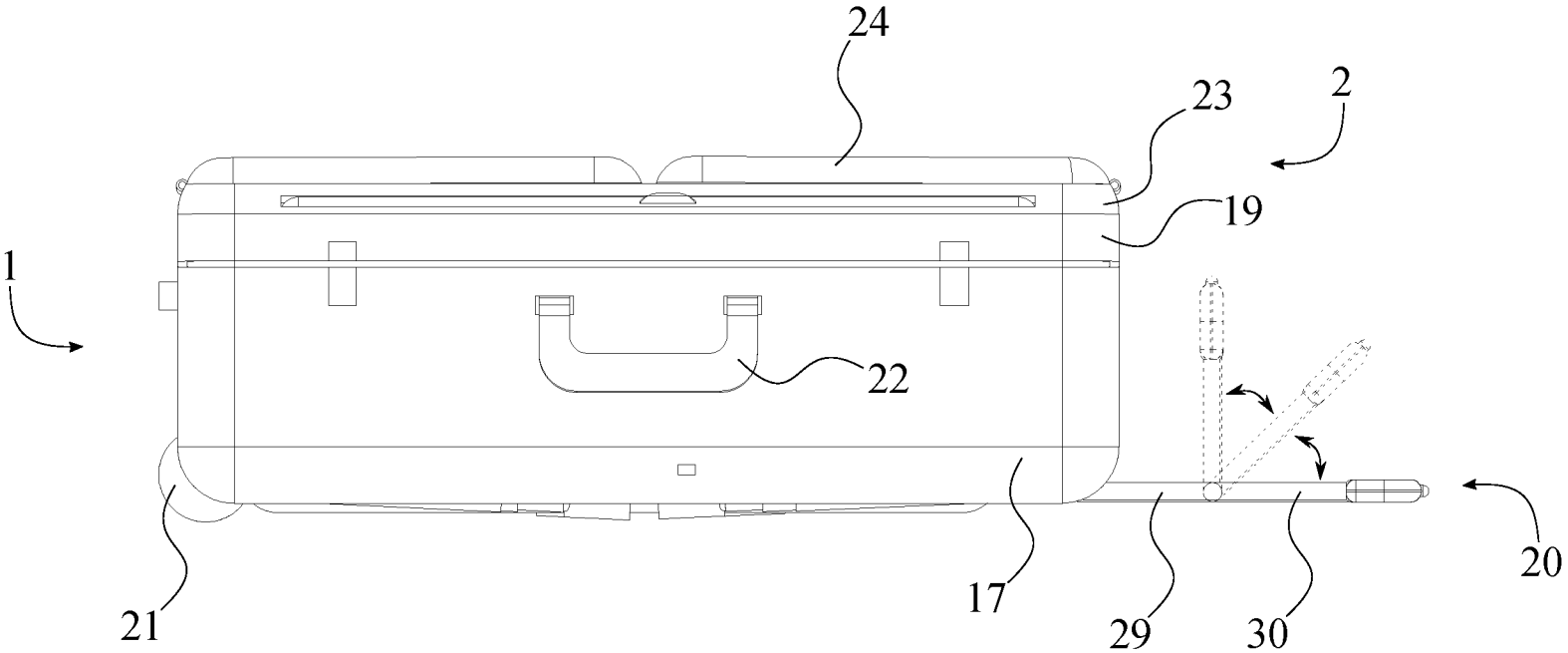
FIG. 4 is a front view of the present invention.
Figure 5:
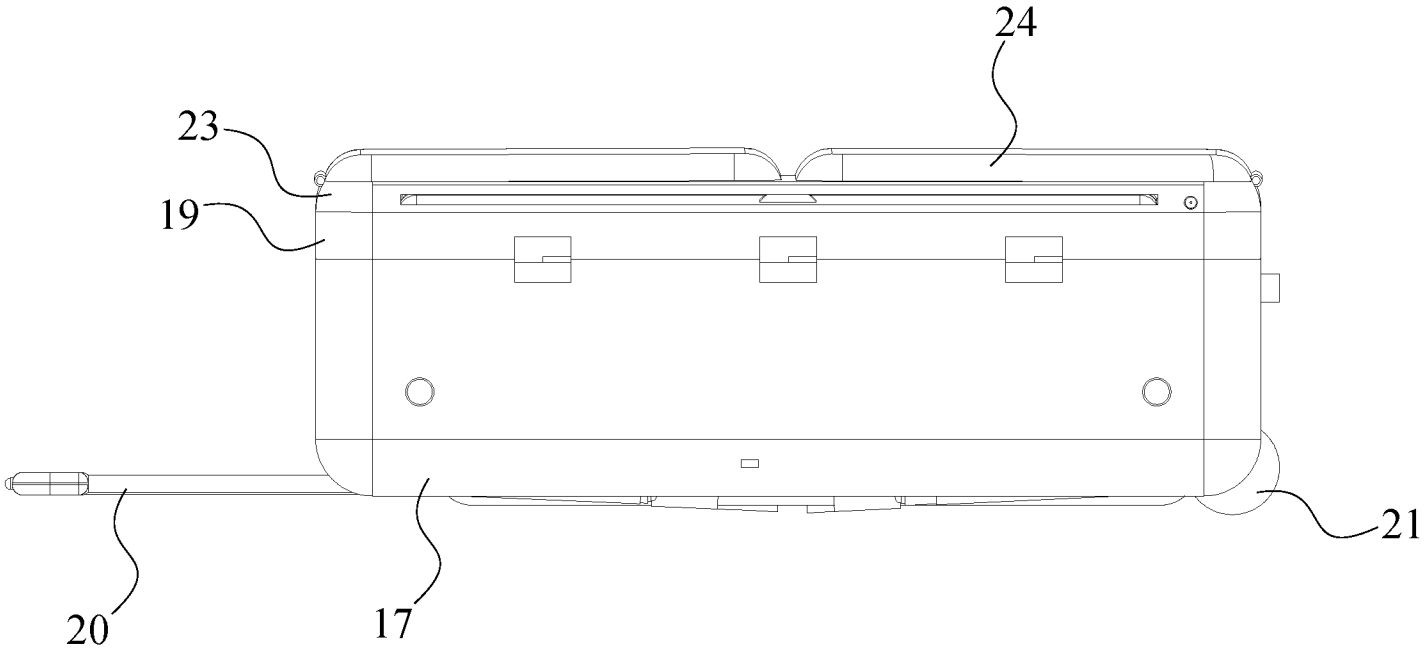
FIG. 5 is a rear view of the present invention.

In accordance to FIG. 4, the extendable handle 20 comprises a first handle portion 29 and a second handle portion 30. The first handle portion 29 engages the luggage body 17 while the second handle portion 30 allows the user to grasp the extendable handle 20 efficiently. The first handle portion 29 is slideably engaged with the luggage body 17 to allows the first handle portion 29 to collapse into the luggage body 17. The second handle portion 30 is telescopically and hingedly connected with the first handle portion 29. The second handle portion 30 is able to collapse into or extend out from the first handle portion 29 for storage or use, respectively. The hinged connection allows the second handle portion 30 to be angularly positioned, such as 90°, 135°, or 180°, with respect to the first handle portion 29 during use, to allow the user to comfortably maneuver the present invention effectively.

Figure 8:
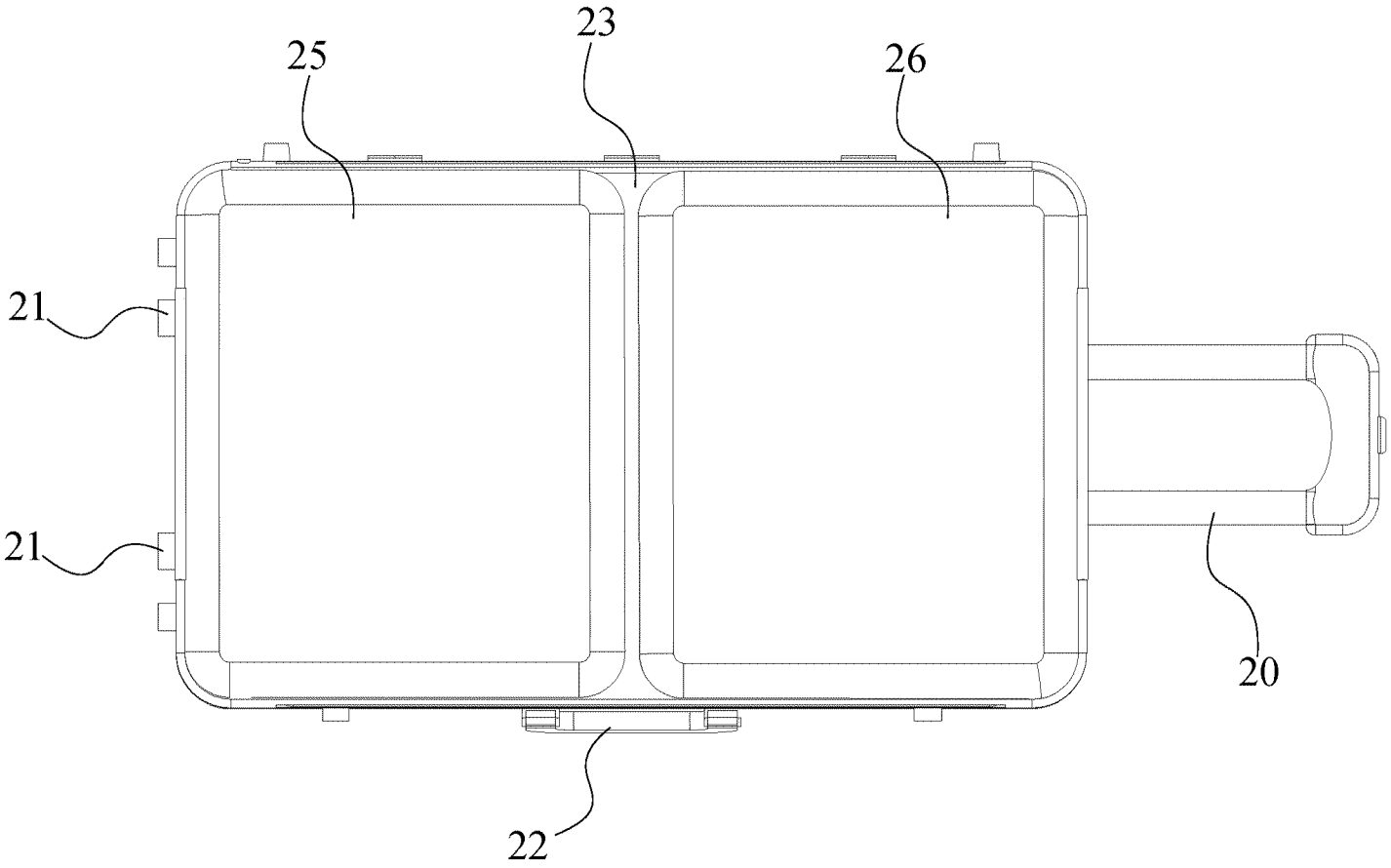
FIG. 8 is a top view of the present invention.

Further in accordance to the preferred embodiment of the present invention, the at least one extendable work surface 24 comprises a first hinged work surface 25 and a second hinged work surface 26, shown in FIG. 3 and FIG. 8. The first hinged work surface 25 is adjacently and hingedly connected to the workstation base 23. Similarly, the second hinged work surface 26 is adjacently and hingedly connected to the workstation base 23. This hinged connection allows the first hinged work surface 25 and the second hinged work surface 26 to collapse onto the workstation base 23 to transport the present invention, or expand away from the workstation base 23 to extend the useable workspace. The first hinged work surface 25 is oppositely positioned to the second hinged work surface 26 to prevent the restriction of motion for either the first hinged work surface 25 or the second hinged work surface 26, as well as, to maximize the accessible workspace surface area provided by the at least one extendable work surface 24.

In some embodiments of the present invention, the at least one extendable work surface 24 comprises a first sliding work surface 27 and a second sliding work surface 28, shown in FIG. 3. Like the first hinged work surface 25 and the second hinged work surface 26, the first sliding work surface 27 and the second sliding work surface 28 extend from and retract within the workstation base 23 to expand the workspace accessible to the user. The first sliding work surface 27 is adjacently and slideably connected to the workstation base 23. Similarly, the second sliding work surface 28 is adjacently and slideably connected to the workstation base 23. The slideable connection allows the user to extend or retract the first sliding work surface 27 and the second sliding work surface 28 out from or into the workstation base 23, respectively, to manipulate the accessible workspace surface area. The first sliding work surface 27 is oppositely positioned to the second sliding work surface 28 about the workstation base 23 to maximize the accessible workspace surface area for the user.

Some embodiments of the present invention comprise the first hinged work surface 25, the second hinged work surface 26, the first sliding work surface 27, and the second sliding work surface 28 to further increase the accessible workspace surface area. The first sliding work surface 27 and the second sliding work surface 28 are positioned between the first hinged work surface 25 and the second hinged work surface 26, detailed in FIG. 3. This configuration allows the first sliding work surface 27 and the second sliding work surface 28 to extend perpendicularly to the first hinged work surface 25 and the second hinged work surface 26 to increase the accessible workspace surface area efficiently.

In still another embodiment of the present invention, the present invention comprises a plurality of supporting casters 6, illustrated in FIG. 3 and FIG. 9. The plurality of supporting casters 6 interface with the ground surface to support the present invention when the present invention is configured as a desk. A corresponding caster from the plurality of supporting casters 6 is adjacently and terminally connected to a corresponding leg support of the first pair of telescoping-leg supports 4, in order to allow the present invention to be pushed or pulled by the user to maneuver the present invention across the ground surface. Similarly, a corresponding caster from the plurality of supporting casters 6 is adjacently and terminally connected to a corresponding leg support of the second pair of telescoping-leg supports 5, in order to allow the present invention to be easily pushed or pulled by the user to maneuver the present invention across the ground surface as the present invention is configured as a desk.

In some embodiments of the present invention, the present invention further comprises at least one storage divider 7, in accordance to FIG. 2. The at least one storage divider 7 allows the user to separate and categorize personal effects to be transported with the present invention. The at least one storage divider 7 is integrated within the storage compartment 18 to segment the volume of the storage compartment 18 into smaller volumes which allow the user to place personal effects within each volume in accordance to personal categorization preferences. The at least one storage divider 7 includes, but is not limited to, shoe storage volume dividers, toiletries volume dividers, or similar segmenting dividers for traveling personal effects.

The present invention further allows the user to connect and charge mobile devices. The present invention comprises a rechargeable battery 8 and at least one mobile device power adapter 9, in accordance to FIG. 10. The rechargeable battery 8 stores electrical charge and is able to discharge the electrical charge to recharge mobile devices. The rechargeable battery 8 is enclosed within the electrical housing 3 to be protected by the electrical housing 3 and prevent the accidental discharge of electricity. The at least one mobile device power adapter 9 provides the electrical connection between the mobile device and the rechargeable battery 8, as well as regulates the current and power to prevent the mobile device from being overloaded. The at least one mobile device power adapter 9 is mounted into the electrical housing 3 in order to be externally accessible for the user. The at least one mobile device power adapter 9 is electrically coupled to the rechargeable battery 8 in order to provide electrical power to the mobile device from the rechargeable battery 8 through the at least one mobile device power adapter 9.

Figure 10:
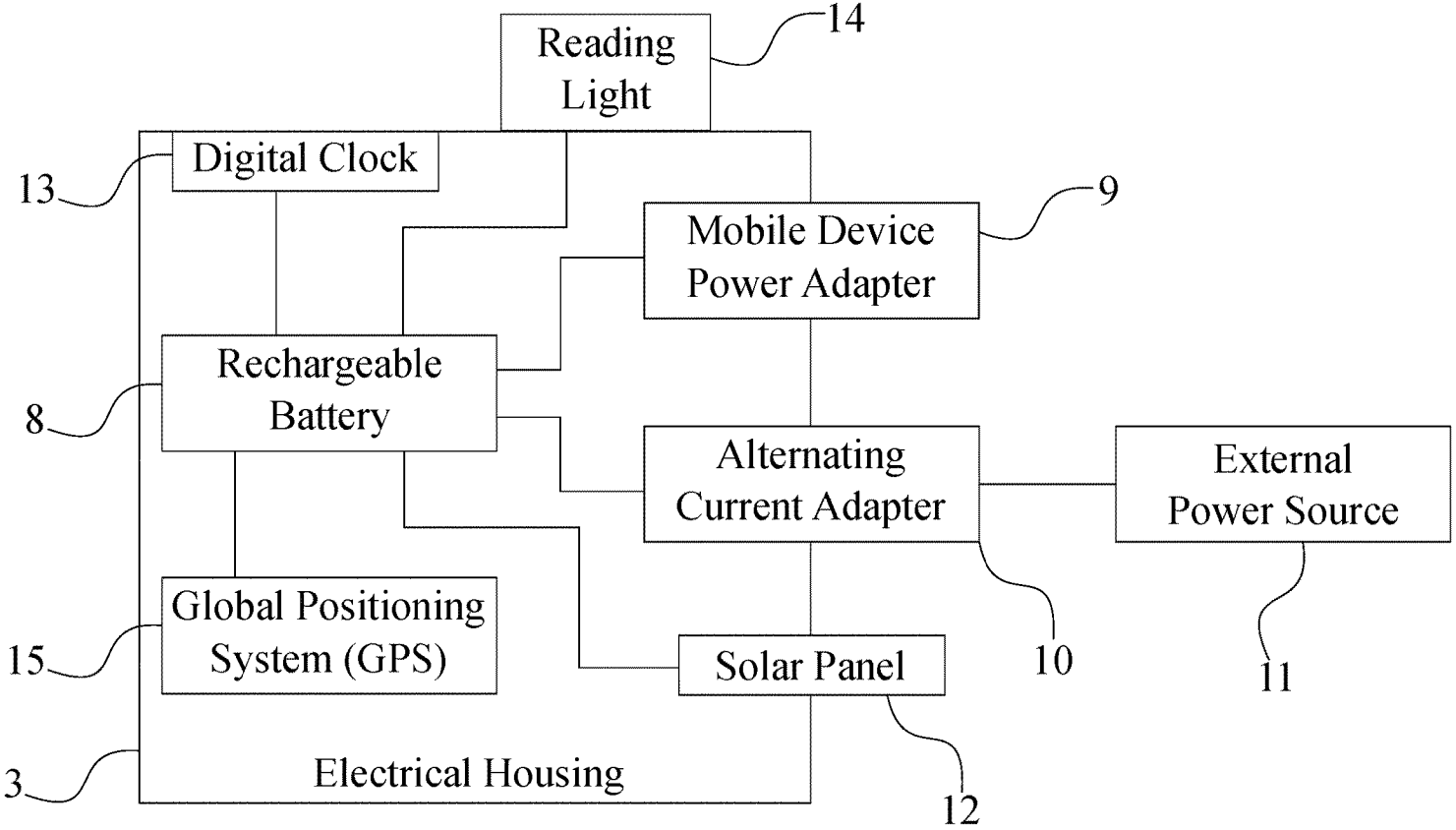
FIG. 10 is a schematic diagram for the electrical components of the present invention within the electrical housing.

In some embodiments of the present invention, the present invention comprises an alternating current adapter 10 and an external power source 11, detailed in FIG. 10. The alternating current adapter 10 regulates current and voltage from the external power source 11 to provide electrical charge for the rechargeable battery 8. The rechargeable battery 8 is electrically coupled with the external power source 11 through the alternating current adapter 10 in order to charge the rechargeable battery 8 after the rechargeable battery 8 has been discharged.

In an alternate embodiment, the present invention comprises a solar panel 12, illustrated in FIG. 10. The solar panel 12 converts solar energy into electrical energy to restore electrical charge to the rechargeable battery 8. The solar panel 12 is externally integrated to the electrical housing 3 to be able to receive solar energy. The solar panel 12 is electrically coupled with the rechargeable battery 8 in order to charge the rechargeable battery 8 after the rechargeable battery 8 has been discharged.

In accordance to other embodiments of the present invention, the present invention comprises a digital clock 13, as shown in FIG. 10. The digital clock 13 displays the current time to the user in order for the user to adhere to the user's itinerary. The digital clock 13 is externally integrated with the electrical housing 3 to be visible to the user. The digital clock 13 is electrically coupled with the rechargeable battery 8 in order to receive the necessary electricity for operation.

In some other embodiments of the present invention, the present invention comprises a reading light 14, in accordance to FIG. 10. The reading light 14 provides light in order for the user to read under the reading light 14 and view the contents of the present invention in dim light or darkness. The reading light 14 is externally mounted to the electrical housing 3 to allow the user focus the direction for a light emission of the reading light 14. The reading light 14 is electrically coupled with the rechargeable battery 8 in order for the reading light 14 to receive electrical power to produce the light emission.

In accordance to yet another embodiment of the present invention, the present invention comprises a global positioning system (GPS) 15, as shown in FIG. 10. The GPS 15 allows the user to locate the present invention should the present invention be lost, misplaced, or stolen. The GPS 15 is mounted within the electrical housing 3 to be secured within the present invention. The GPS 15 is electrically coupled with the rechargeable battery 8, such that the rechargeable battery 8 provides the power for the transmission of global coordinates to identify the location of the present invention.

In still another embodiment of the present invention, the present invention comprises a radio frequency identification (RFID) blocking compartment 16, in accordance to FIG. 2. The RFID blocking compartment 16 prevents RFID signals from being transmitted through the RFID blocking compartment 16. The RFID blocking compartment 16 is integrated within the storage compartment 18 to receive credit cards or similar objects that may be read using RFID technology. The RFID blocking compartment 16 prevents information stored on the user's credit card from being obtained by a passerby using an RFID reader.

Although the invention has been explained in relation to its preferred embodiment, it is to be understood that many other possible modifications and variations can be made without departing from the spirit and scope of the invention as hereinafter claimed.

What is claimed is:

1. An adaptable luggage case and workspace combination comprises:

a luggage case;

a collapsible workstation;

an electrical housing;

a first pair of telescoping-leg supports;

a second pair of telescoping-leg supports;

the luggage case comprises a luggage body, a storage compartment, and a case lid;

the collapsible workstation comprises a workstation base and at least one extendable work surface;

the storage compartment traversing into the luggage body;

the case lid being perimetrically connected to the luggage body about the storage compartment;

the workstation base being adjacently connected to the case lid;

the workstation base being oppositely positioned to the storage compartment about the case lid;

the at least one extendable work surface being connected to the workstation base;

the electrical housing being laterally integrated into the luggage body;

the first pair of telescoping-leg supports and the second pair of telescoping-leg supports being hingedly connected to the luggage body, opposite to the case lid;

the first pair of telescoping-leg supports and the second pair of telescoping-leg supports being positioned opposite to each other across the luggage body;

the at least one extendable work surface comprises a first hinged work surface, a second hinged work surface, a first sliding work surface and a second sliding work surface; and the first sliding work surface and the second sliding work surface being positioned between the first hinged work surface and the second hinged work surface.

2. The adaptable luggage case and workspace combination, as claimed in claim 1, comprises:

each of the first pair of telescoping-leg supports being offset from each other; and each of the second pair of telescoping-leg supports being offset from each other.

3. The adaptable luggage case and workspace combination, as claimed in claim 1, comprises:

the luggage case further comprises an extendable handle and a pair of casters;

the extendable handle being telescopically integrated into the luggage body;

the extendable handle being positioned opposite to the case lid;

the pair of casters being rotatably and laterally connected to the luggage body; and the extendable handle being oppositely oriented to the pair of casters about the luggage body.

4. The adaptable luggage case and workspace combination, as claimed in claim 3, comprises:

the pair of casters being oppositely positioned to the case lid; and the pair of casters being offset from each other.

5. The adaptable luggage case and workspace combination, as claimed in claim 3, comprises:

a lateral handle;

the lateral handle being laterally and centrally connected to the luggage body.

6. The adaptable luggage case and workspace combination, as claimed in claim 3, comprises:

the extendable handle comprises a first handle portion and a second handle portion;

the first handle portion being slideably engaged with the luggage body; and the second handle portion being telescopically and hingedly connected with the first handle portion.

7. The adaptable luggage case and workspace combination, as claimed in claim 1, comprises:

the at least one extendable work surface comprises the first hinged work surface and the second hinged work surface;

the first hinged work surface being adjacently and hingedly connected to the workstation base;

the second hinged work surface being adjacently and hingedly connected to the workstation base; and the first hinged work surface being oppositely positioned to the second hinged work surface about the work station base.

8. The adaptable luggage case and workspace combination, as claimed in claim 1, comprises:

the at least one extendable work surface comprises the first sliding work surface and the second sliding work surface;

the first sliding work surface being adjacently and slideably connected to the workstation base;

the second sliding work surface being adjacently and slideably connected to the workstation base; and the first sliding work surface being oppositely positioned to the second sliding work surface about the workstation base.

9. The adaptable luggage case and workspace combination, as claimed in claim 1, comprises:

a plurality of supporting casters; and a corresponding caster from the plurality of supporting casters being adjacently and terminally connected to a corresponding leg support of the first pair of telescoping-leg supports.

10. The adaptable luggage case and workspace combination, as claimed in claim 1, comprises:

a plurality of supporting casters; and a corresponding caster from the plurality of supporting casters being adjacently and terminally connected to a corresponding leg support of the second pair of telescoping-leg supports.

11. The adaptable luggage case and workspace combination, as claimed in claim 1, comprises:

at least one storage divider; and the at least one storage divider being integrated within the storage compartment.

12. The adaptable luggage case and workspace combination, as claimed in claim 1, comprises:

a rechargeable battery;

at least one mobile device power adapter;

the rechargeable battery being enclosed within the electrical housing;

the at least one mobile device power adapter being mounted into the electrical housing; and the at least one mobile device power adapter being electrically coupled to the rechargeable battery.

13. The adaptable luggage case and workspace combination, as claimed in claim 12, comprises:

an alternating current adapter;

an external power source; and the rechargeable battery being electrically coupled with the external power source through the alternating current adapter.

14. The adaptable luggage case and workspace combination, as claimed in claim 12, comprises:

a solar panel;

the solar panel being externally integrated to the electrical housing; and the solar panel being electrically coupled with the rechargeable battery.

15. The adaptable luggage case and workspace combination, as claimed in claim 12, comprises:

a digital clock;

the digital clock being externally integrated with the electrical housing; and the digital clock being electrically coupled with the rechargeable battery.

16. The adaptable luggage case and workspace combination, as claimed in claim 12, comprises:

a reading light;

the reading light being externally mounted to the electrical housing; and the reading light being electrically coupled with the rechargeable battery.

17. The adaptable luggage case and workspace combination, as claimed in claim 12, comprises:

a global positioning system (GPS);

the GPS being mounted within the electrical housing; and the GPS being electrically coupled with the rechargeable battery.

18. The adaptable luggage case and workspace combination, as claimed in claim 1, comprises:

a radio frequency identification (RFID) blocking compartment; and the RFID blocking compartment being integrated within the storage compartment.

* * * * *